US005174910A

United States Patent [19]

Pita

[11] Patent Number: 5,174,910

[45] Date of Patent: Dec. 29, 1992

[54] MOLD FOR FORMING PILOT ANCHOR HOLES IN CONCRETE

[76] Inventor: Enrique A. Pita, 1068-D, Summit Trails Cir., West Palm Beach, Fla. 33415

[21] Appl. No.: 585,805

[22] Filed: Sep. 20, 1990

[51] Int. Cl.[5] ..... B28B 7/16; B28B 7/28

[52] U.S. Cl. ..... 249/112; 52/699; 52/701; 249/83; 249/176; 249/177; 249/183

[58] Field of Search ..... 249/9, 34, 64, 83, 86, 249/91, 98, 176, 177, 219.1, 112, 114.1, 183; 52/699, 701, 705, 711

[56] References Cited

U.S. PATENT DOCUMENTS

| | | | |
|---|---|---|---|
| 2,467,115 | 4/1949 | Duggan | 72/108 |
| 2,560,951 | 7/1951 | Henderson et al. | 52/701 |
| 3,089,191 | 5/1963 | Conrad | 425/383 |
| 3,403,484 | 10/1968 | Redey | 425/DIG. 124 |
| 3,479,785 | 11/1969 | Asch | 425/110 |
| 3,937,119 | 2/1976 | Ernst | 85/47 |
| 3,964,219 | 6/1976 | Hala | 52/699 |
| 3,965,510 | 6/1976 | Ernst | 7/158 |
| 4,202,149 | 5/1980 | Betrue, Sr. | 52/699 |
| 4,404,781 | 9/1983 | Gilb | 52/295 |
| 4,642,964 | 2/1987 | Kellison | 52/699 |

OTHER PUBLICATIONS

Simpson Strong-Tie Company catalog C-89H-1, 1989, p. 36.

Palm Beach County Illustrated Code Requirements for One & Two Family Dwellings, West Palm Beach, Fla., Apr. 1987.

Kant-Sag Construction Hardware, United Steel Products Co., 1987, p. 22.

*Primary Examiner*—Jay H. Woo
*Assistant Examiner*—James P. Mackey
*Attorney, Agent, or Firm*—Quarles & Brady

[57] ABSTRACT

A plurality of pilot hole impressing molds connected to a generally flat base structure constructed of resilient materials temporarily attached to the inner face of the temporary forms for the formation of the concrete structure. As concrete sets the forms and the pilot molds are removed exposing the pilot holes. Pilot mold extensions may be modified with metal caps and temporarily attached. As concrete sets and forms and molds are removed, the metal caps remain permanently embedded in the concrete structure.

7 Claims, 8 Drawing Sheets

MOLD FOR FORMING PILOT ANCHOR HOLES IN CONCRETE

BACKGROUND OF THE INVENTION

1. Field of the Invention

The present invention relates to anchoring into concrete. More specifically, the present invention relates to a pilot holes mold that when placed on the concrete forms and as concrete is poured and sets, pilot holes are impressed in it.

2. Prior Art

At the present time anchoring into precast concrete or other prefabricated concrete components, is generally done with powder actuated fasteners and by drilling in the concrete to install anchors.

Powder actuated fasteners often break the surface of these high strength concrete structures and drilling into them is extremely difficult.

Considering the number of building members and parts requiring connection to a concrete structure such as; wood framing, wood trusses, clips and hangers for plumbing pipes, duct systems, electrical conduits, equipment, suspension systems for ceiling components, electric fixtures and many others, one can judge the amount of work and expense involved with the use of powder actuated fasteners or by anchoring into drilled holes.

These time consuming methods require the use of very expensive special tools which are often lost in the job, plus costly powder loads and masonry drill bits.

Another method commonly used to anchor wood members to poured in place concrete structures is embedding metal connectors as the concrete is poured and leveled off.

Embedded connectors will then anchor wood frame walls to poured in place concrete structures such as; footings, monolithic footing-slabs, bond beams, walls, where each wood member must be connected.

Installation of floor or roof trusses over masonry walls, requires connection of each truss to the embedded connectors in the bond beams.

Anticipated placing of embedded connectors must carefully follow the spacing of the wood members in the architectural and engineer plans as these wood members must fall vertically and directly over the embedded connectors.

Skilled help is required with knowledge of construction practices, codes regulations and plan reading to provide the layout marks on the form boards for anticipating the location of embedded connectors.

As concrete is poured connectors are embedded at their anticipated locations marked on the concrete forms, once it sets, construction proceeds with the erection of wood members.

Simpson Strong-Tie catalog C-89H-1, page 36, Models ETA, ETAT are examples of wood to concrete connectors. Palm Beach County Illustrated Code provides an example of wood to concrete connector requirements.

At this time is found that a vast majority of the wood members do not coincide with the connectors previously embedded in the concrete structure. A very common problem with a costly solution.

New connectors must be fixed to the concrete with powder actuated fasteners. A minimum of 4 1¼ inch long steel fasteners per connector must be used. Example; Low velocity fastening systems, Ramset, File LOVEL 18A May 24, 1985.

When many connectors, usually more than three connectors in a building, are added or replaced with powder actuated fasteners, its installation must be inspected and certified by a professional engineer.

This procedure proves costly; loss of material and labor for misplaced embedded connectors; the need for skilled help; labor and materials to install replacement connectors; expensive powder actuated fasteners; plus required engineer certification for repairs.

Anchoring methods presently used have metal upstanding and protruding over or out from the forms or extending upward in bond beams, walls, slabs, which interfere with the finishing of the concrete surfaces, and create hazardous obstacles to workers erecting the wood structural members around them.

When a wood sill plate is used to connect wood members to concrete, the sill must first be attached to the top of the foundation, slab, wall or beam. There are several ways to attach a wood sill plate to the top of a concrete structure.

The oldest way is to insert threaded anchor bolts into the concrete as soon as the pour is completed and leveled off. Holes are drilled in the wood sill plate and is then set on the foundation with the anchor bolts protruding through the holes and fixed in place with washers and nuts.

Several manufacturers are offering sheet metal connectors which replace the threaded bolts in wood sill plates. An example of a sheet metal anchor is found in U.S. Pat. No. 4,404,781.

Wood members erected over a wood sill will then require additional wood to wood connectors, such as the Hurricane Tie RT-12 manufactured by United Steel illustrated in the Kant-Sag 1987 Catalog page 22. It takes 2 RT-12 clips and 12-8d or 16-6d galvanized nails to connect each member to the wood sill plate.

The wood sill method translates into a great labor and material consuming task and often damage wood members caused by the excesive nailing required for wood to wood connectors.

Another method presently in use to anchor connectors in concrete is the Tapcon concrete fastening system. It requires a hammer drill and a special Condrive tool to drill into the concrete and to drive the anchor in the drilled hole.

The hole is drilled ¼ inch longer than the anchor then the dust is removed with the aid of a blow out bulb or compressed air, and using the Condrive tool the Tapcon threaded anchor is installed. These products are covered under U.S. Pat. Nos. 3,937,119 and 3,965,510.

Previously mentioned methods are time consuming, some require additional wood to wood connectors, others require expensive special tools.

Anticipated location for embedding connectors in concrete must be done by skilled help and create hazardous conditions for workers.

Replacing misplaced embedded connectors with powder actuated fasteners must be certified by a professional engineer.

In view of these and other prior art deficiencies, it is accordingly the primary objective of the present invention to provide a new and novel article of molding to make pilot hole impressions in concrete means for anchoring connectors in concrete structures.

SUMMARY OF THE INVENTION

The principal object of the present invention is to make anchoring to concrete a simple task, by making pilot holes impressions generally and throughout predetermined areas of the concrete structure where anchoring will take place.

This is achieved by attaching the pilot molds continuously to the concrete forms in the general areas or perimeter of the concrete structure where other building components are to be erected and connected.

The pilot molds are attached to the inner side of the concrete forms, as concrete is poured and sets, pilot holes are impressed in it.

The hole made with the pilot mold is clean and well finished thus no dust removal is needed.

The present invention requires no skill trades, no special tools and allows proper anchoring of other components without having to anticipate their location in the structure.

Eliminates the use of powder actuated fasteners, drilling into the concrete as well as anticipated embedment of metal connectors, consequently there is no construction time loss, no damage to the concrete structure, no waste in labor and materials and no expensive engineer certification for repairs.

The pilot hole mold made of resilient plastic materials easily disengage from the concrete with the forms or after the forms are removed.

These plastic compositions will not corrode rust or tarnish, and are not harmed by acids.

Cleaning the pilot molds with mild acid mixtures will restore their finish. The molds can be reused many times thus reducing their low initial cost.

Hazardous conditions created by embedded metal connectors extending out of the concrete structure is eliminated together with their expensive guess work.

Strikes out the laborious use of wood sills and the required installation of additional wood to wood connectors.

Pilot holes made in prefabricated prestressed concrete components provide the means for anchoring hangers and connectors, thus avoiding the expensive use of powder actuated fasteners or drilling in concrete, methods which often are the cause of injury to workers.

After installation and finishing of concrete, and as concrete sets, the forms are removed, the base of the mold is exposed. The well finished, waxed like surfaces of the resilient plastic molds easily disengage from the concrete.

As the pilot holes mold is pulled out, a plurality of pilot holes are exposed in a continuous arrangement throughout the concrete structure.

Construction proceeds through normal steps, with the erection of wood members spaced as per plans and building codes and the installation of all other components requiring connection to the poured in place or prefabricated concrete structures.

Hammer driven hardened steel nails, threaded anchors, expansion anchors, impact anchors, metal hit anchors, adhesive anchors and any other suitable type of anchors or expansion devices, will fasten the required connectors and hangers into the pilot holes providing the connection for other parts at their exact location.

In the event of changes, misplacement, addition of other items, connectors can be relocated or added and anchored into pilot holes casted throughout the entire area or perimeter of the structure with no waste, minimal effort and expense.

It also is an object of the present invention to provide such a device which is reusable, and of simple, inexpensive construction.

The pilot holes mold totally supplants the presently used methods, at a fraction of their installed cost, with considerable savings in construction time.

Another object of the invention, is to provide such a device, that its installation is accomplished requiring no special tools and no skilled trades.

The pilot hole mold constructed of resilient materials, preferably plastic compositions, for use in accordance with the present invention are those low density, high molecular weight polymer, preferably having molecular weight ranges from about 100,000 to about 200,000 and above, and crystallinity ranges from thirty to about seventy percent and above.

Such plastics can be modified by the addition of stabilizers, molding powders and the like, to provide the proper resiliency. Polyvinylcloride and polypropylene are particular satisfactory in the practice of this invention.

Such plastic compositions can be extruded or molded in a variety of sizes and shapes, and are particularly suitable from a cost-effectiveness standpoint.

An advantage of such plastics is that, generally, even off specification, products can be used quite effectively.

These plastic compositions materials are recyclable.

Iron, steel, or combinations of metals and plastics however can be used.

This objects and others are achieved in accordance with the present invention which contemplates a mold for making pilot holes that installed continuously on the concrete forms, will impress pilot holes of a predetermined type, shape and size in the precast or poured in place concrete structures.

The pilot holes mold can be permanently or temporarily attached to the concrete forms.

Generally the pilot holes mold can be constructed in many different ways such as:

a. Concrete forms with pilot molds attached for use in the fabrication of poured in place, precast, blocks and other formed concrete structures;
b. Pilot holes mold constructed of plastics or metal integrally connected with a base;
c. A mold base constructed with pilot molds integrally connected provided with coupling means for temporary attachment of metal caps. Such caps released in the concrete providing means for anchoring fasteners;
d. A base with holes to receive separately made pilot molds. This system will allow the use of the same type base and any different type of pilot molds attached.

The predetermined dimensions and shape of the pilot holes will be such, as to accept any of a variety of fasteners sizes and types presently available.

The pilot hole mold lends itself to be slightly wider than the anchor in its outward section or base, thus casting a slightly larger hole at its entry section which prevents the concrete surface from breaking as anchors are driven into it.

Attachment of the mold base to the concrete form can be achieved in many ways such as; tacking, stapling, magnetic strips, or suspended from the concrete form, to name a few.

The substantially flat structure of the mold base constructed of resilient plastic materials and integrally connected to the pilot hole mold adapts to the form board and lay flat against it, thus preventing concrete from entering between the form and the base of the mold.

The pilot mold permits full concrete finishing, manual or machine operation without interference in any direction.

The concrete structure remains free of protruding elements in any direction, therefore framing, placing or lifting other components over this areas will not present obstacles for their erection and connection or hazardous conditions to workers.

Generally the pilot hole mold may be made in many different types, shapes and functions:

a. A modified pilot mold with a metal cap temporarily attached to the plastic section of the pilot mold extensions and designed to be released and remain embedded in the concrete as the pilot holes mold is removed;
b. The pilot mold metal cap may be threaded to accept threaded anchors. Many modifications are possible using this metal cap.
c. A metal cap temporarily attached to the plastic pilot mold extensions and designed to stay embedded in the concrete and said cap with locking tabs to engage into annular grooves provided on the fastener.
d. Separately made pilot molds extensions of any dimensions and shape, made of resilient plastic materials, metal or combinations of metal and plastic and conveniently attached to a base such as a form board, a plastic or metal base could be useful for some types of installations.

Rectangular shaped pilot holes for use with rectangular anchors will have wall area over twenty two percent greater than round holes for round anchors thus friction hold increases accordingly.

The invention will be better understood by reference to the attached drawings and to the detailed description which makes reference thereto.

DETAILED DESCRIPTION OF THE PREFERRED EMBODIMENTS

Figure 1:
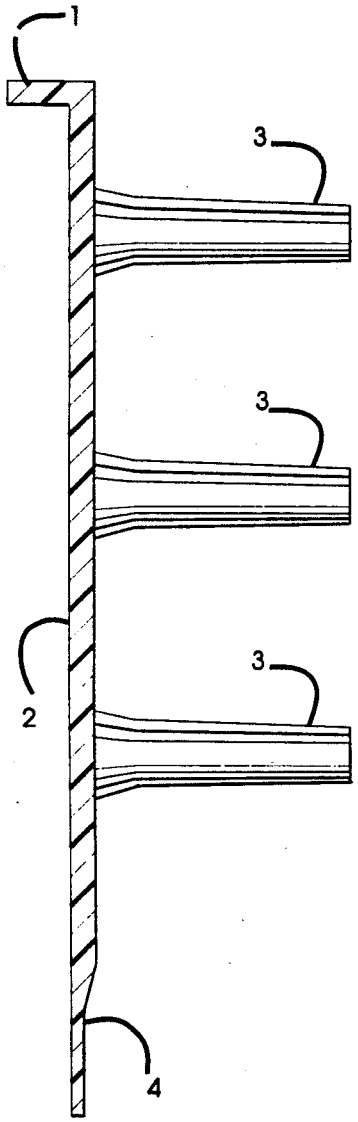
FIG. 1 is the pilot mold shown in cross section taken along lines 1—1 of FIG. 2 of the present invention.

Referring to FIG. 1, a sectional view of the resilient plastic mold structure manufactured by extruding a plastic composition through a die having the shape of the cross section as a continuous body and then cut into desired lengths. The mold structure shown in a 3 pilot molds per vertical rows.

Figure 2:
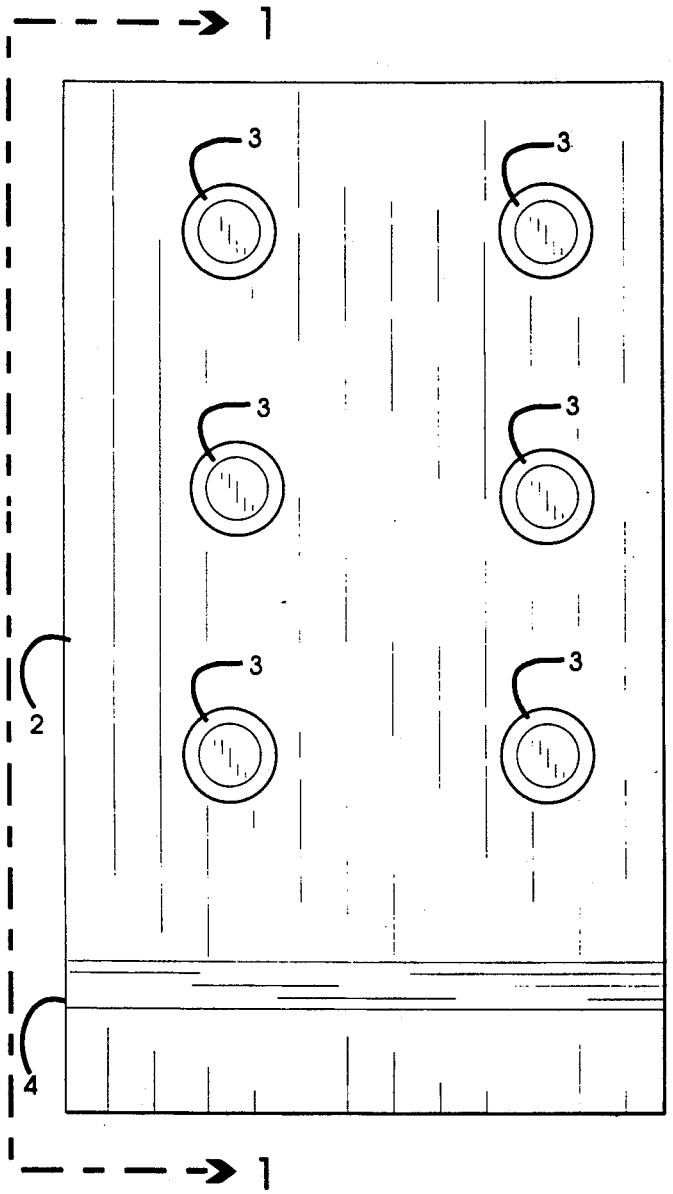
FIG. 2 is a back view of a portion of the mold in FIG. 1.

Extensions 3 can then be sliced or cut to desired spacing and molded to shape and length to provide a plurality of pilot molds 3 continuously in the base structure 2 of the mold as shown in FIG. 2.

Referring to FIGS. 1 and 2 of the pilot mold structure, can be conveniently made by injection molding.

Figure 3:
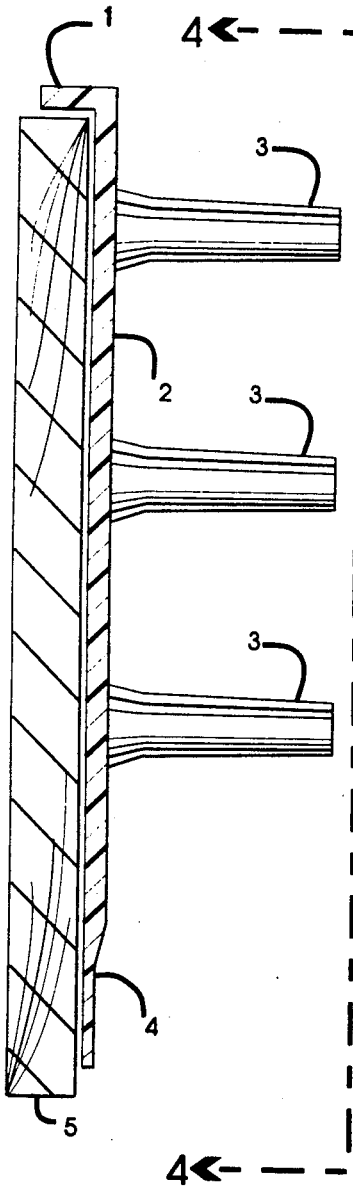
FIG. 3 is a cross section view of FIG. 4, taken in the direction of the arrows 3—3 showing the mold positioned in the inner face of the concrete form board 5.
Figure 4:
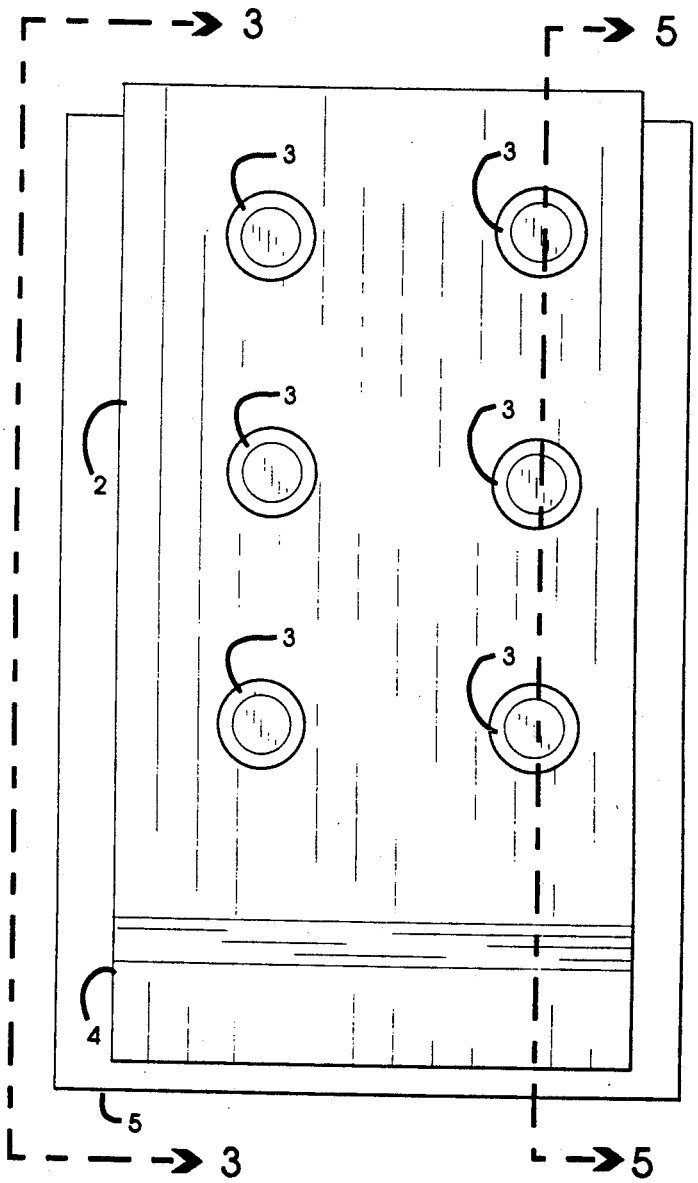
FIG. 4 is a rear elevation view of a section of the form board 5 and mold taken in the direction of the arrows 4—4 in FIG. 3.

Upper bend 1 of the structure provides a support for hanging the mold to the edge of the form board 5 as shown in FIG. 3 and FIG. 4, preventing concrete from entering between mold and form board from the top. The preselected angular relationship at 1 and 2 of the base will assist in maintaining the mold flat against the form board 5 and also sets the pilot hole distance from the edge of the concrete structure.

It should also be noted that part 1 of the mold provides an area for fixing the mold to a form with staples or tacks.

The fine skirt 4 of the resilient plastic mold will provide a seal at the lower part of the mold thus preventing concrete from entering between the mold and the form board.

Figure 5:
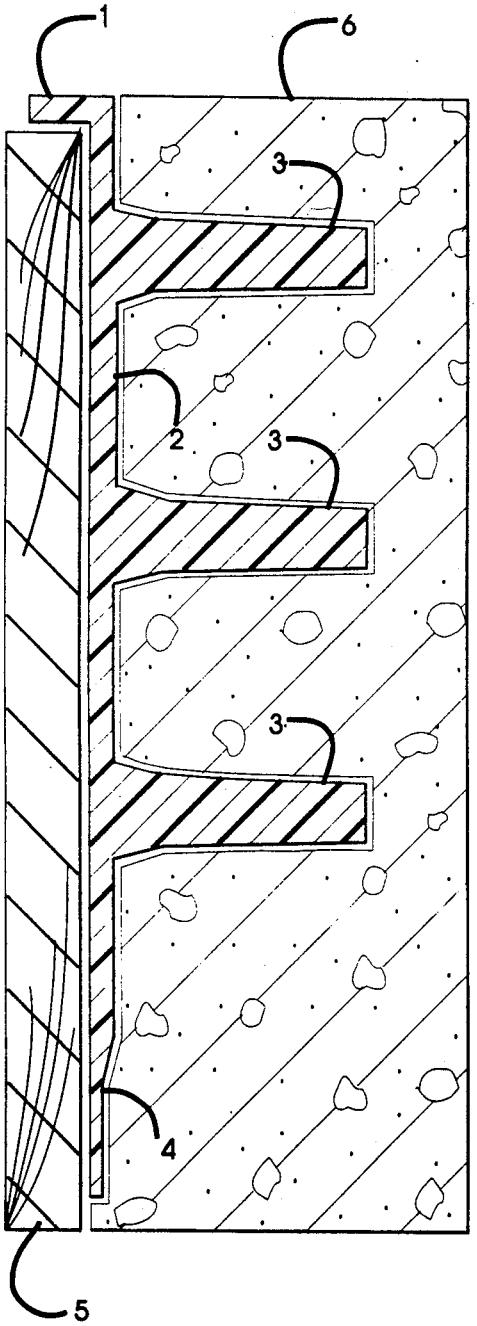
FIG. 5 is a cross sectional view of the mold suspended from the form board taken in the direction of the arrows 5—5 as shown in FIG. 4, and embedded in concrete.

The preferred embodiment in FIG. 5 is a cross section of the pilot hole mold as shown in FIG. 1 attached to a form board 5 and embedded in concrete 6. The pilot mold impressions 7 shown in FIG. 6 are exposed as forms and mold are removed from the concrete structure.

Figure 6:
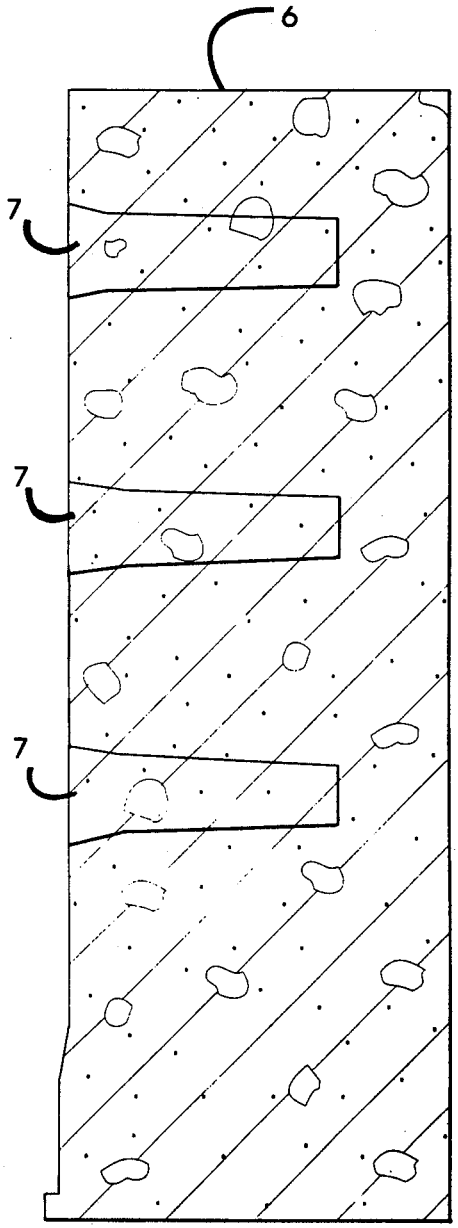
FIG. 6 is a cross sectional view of the concrete 6, FIG. 5, after removal of form board and mold and showing the pilot holes mold impression 7.
Figure 7:
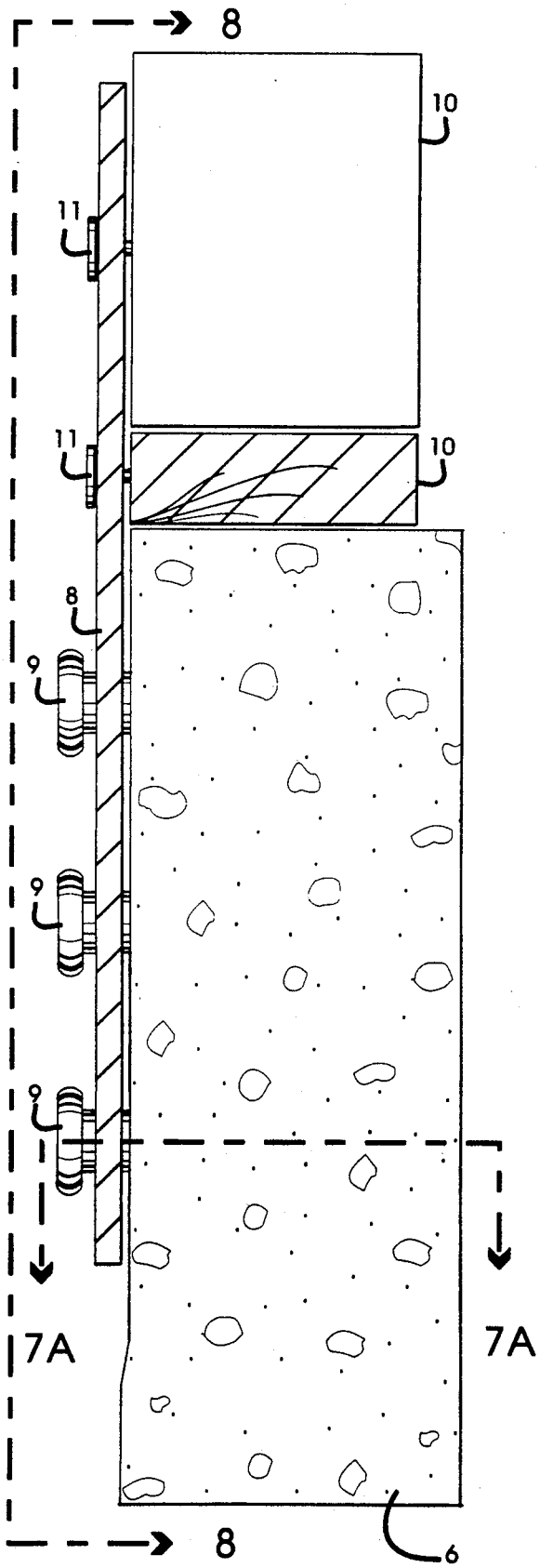
FIG. 7 is a cross sectional view of molded concrete shown in FIG. 6 and metal connector anchored to the concrete structure into pilot holes 7 and to wood members 10 with nails 11.
Figure 8:
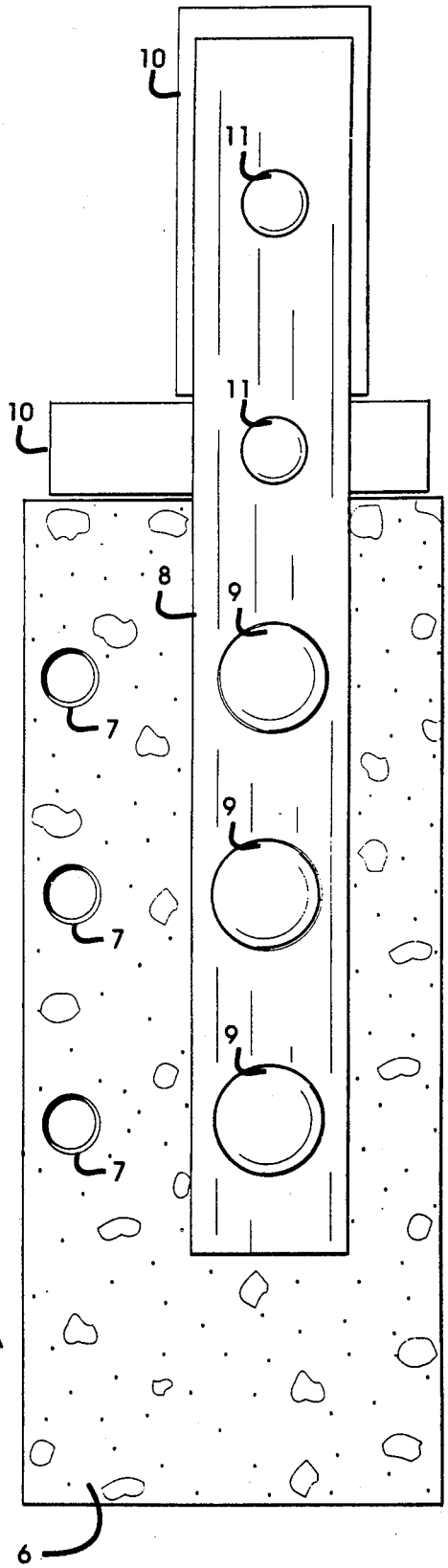
FIG. 8 is a front elevation view of FIG. 7, showing additional unused pilot holes.

Referring to FIGS. 7 and 8 the concrete structure in FIG. 6 is shown with a metal connector 8, anchored into pilot holes 7, with hammer driven steel pins 9 and wood members 10 fixed to metal connector 8 with nails 11. Additional available pilot holes 7 are shown in the concrete structure FIG. 8.

Figure 7A:
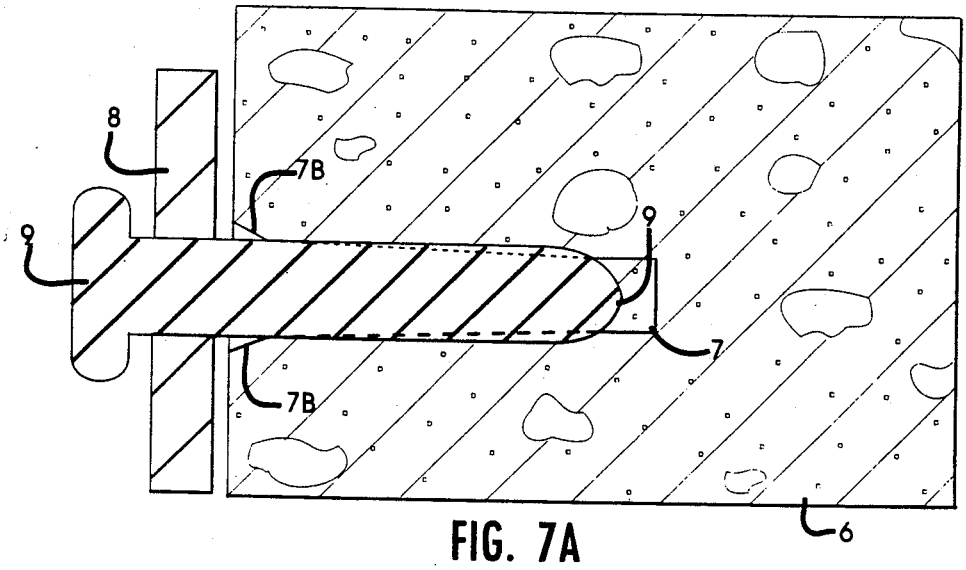
FIG. 7*a* is an exploded view of a cone shaped pilot hole and fastener in FIG. 7.

The exploded view of section 7*a* in FIG. 7 is shown in FIG. 7A. The concrete 6 with conical shaped pilot hole 7 where the base of the cone 7*b*, is larger in diameter than the fastener 9, thus preventing the face of the concrete from breaking. Anchoring value is increased as the fastener is driven in to the narrow end of the cavity. For drawing clarity, 9 is a plain type fastener.

Figure 9:
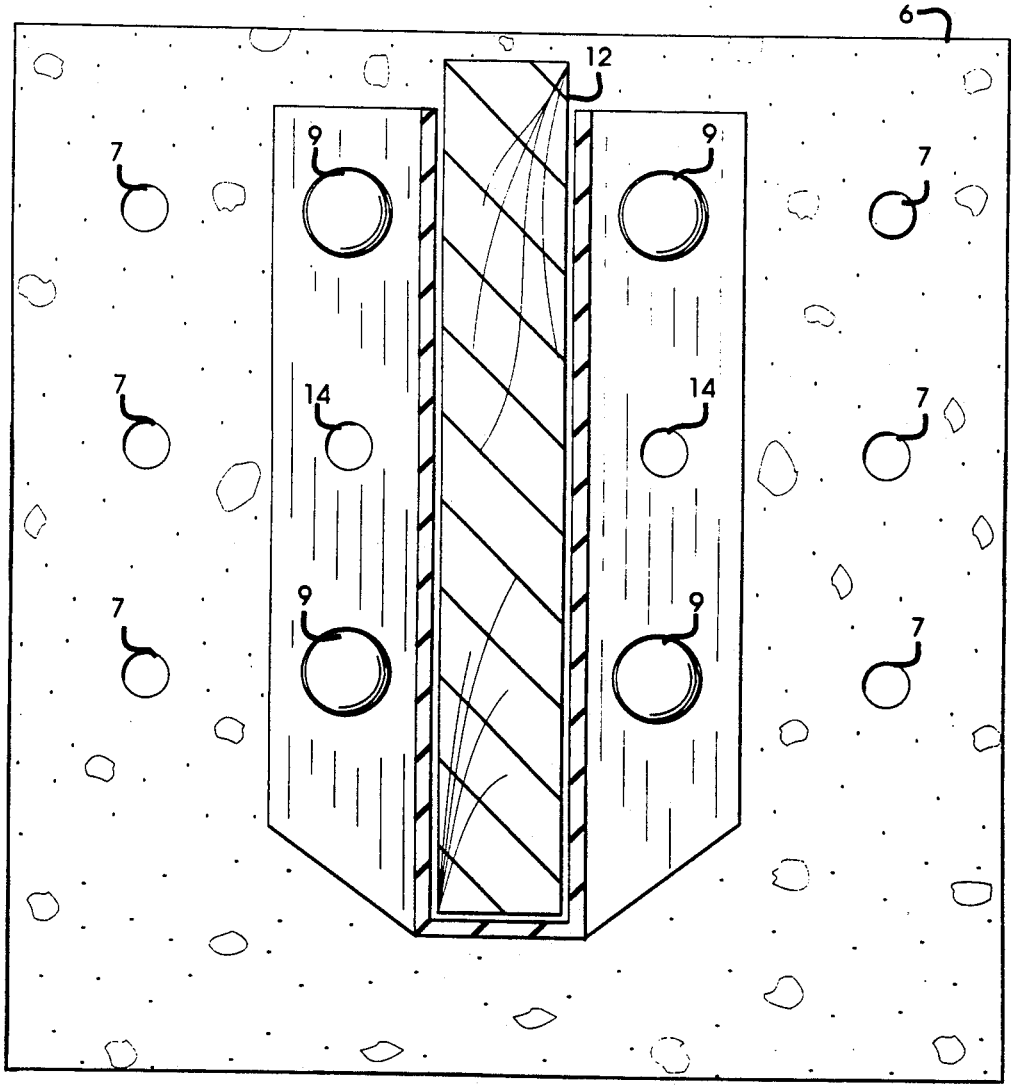
FIG. 9 is a portion of a concrete structure with a wood member in a metal hanger, fixed to structure into pilot holes and showing additional unused pilot holes.

Depicted in FIG. 9, is a portion of the concrete structure 6 with a metal hanger 13 fixed to the concrete with fasteners 9, showing unused fastener holes 14, and sustaining a wood member 12 and additional pilot holes 7 in the concrete.

Figure 10:
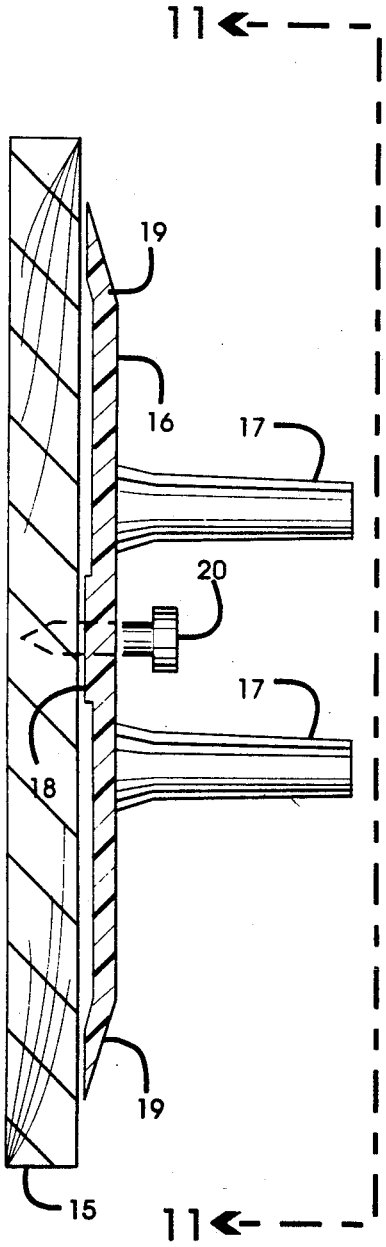
FIG. 10 is cross section of a modified base structure of the mold and pilot molds of the invention.

A modified form of the invention shown in FIG. 10 attached to form board 15, with nail 20 through thickened area 18 of the base structure 16 and base structure ends 19 in full contact with the concrete form and a plurality pilot molds 17 extending from the base structure. Holes for nails 20 are provided throughout thickened area 18 of the base structure.

Figure 11:
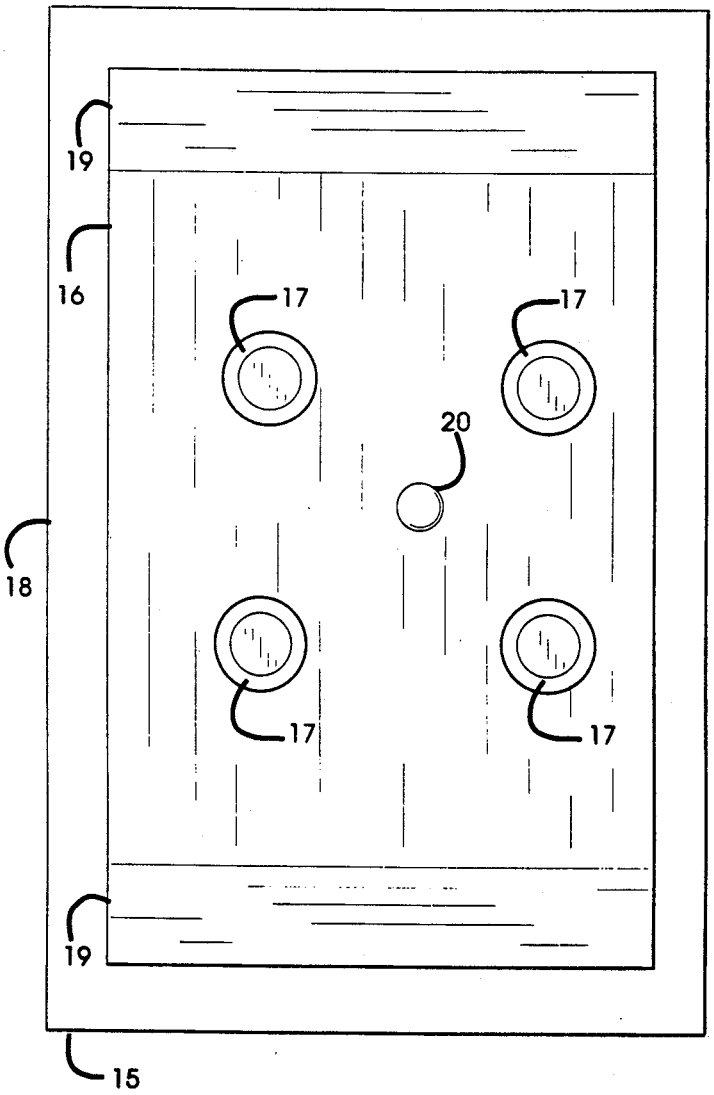
FIG. 11 is a rear view of the modified form of the mold taken in the direction of arrows 11—11 in FIG. 10.

A portion of the pilot holes mold back view in FIG. 11 taken along lines 11—11 in FIG. 10, showing the base 16 and a plurality of pilot molds 17 and nail 20 through thickened area 18 of the base fixing the mold to the concrete form.

The modified anchor pilot hole casting mold in FIGS. 10 and 11 can be conveniently made by extrusion and injection molding methods.

Figure 12:
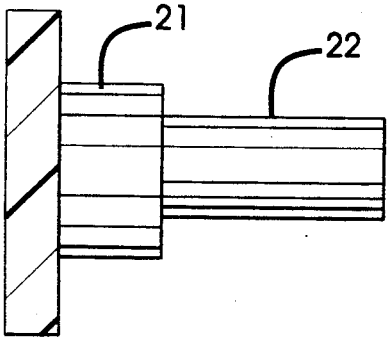
FIG. 12 is a side view of a modified pilot mold for metal cap attachment.

Shown in FIG. 12 is a modified stepped down pilot mold 21 and narrowed extension 22.

Figure 13:
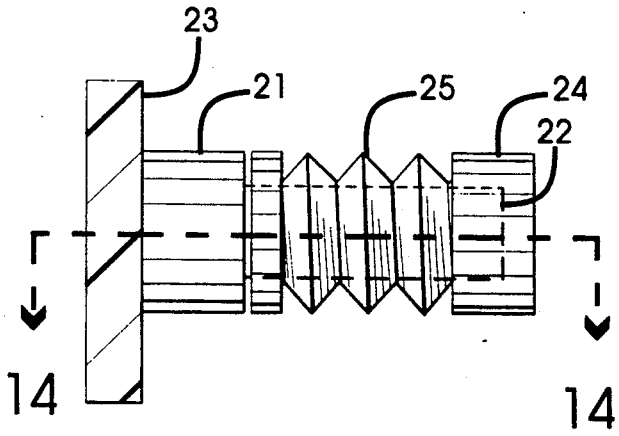
FIG. 13 is the sectional view of part of the base structure with modified pilot mold and threaded metal cap attached.

In FIG. 13 the modified pilot mold 21 is integrally connected to the mold base structure 23 and narrow extension 22 of the pilot mold engaged into the threaded portion 25 of the metal cap 24.

Figure 14:
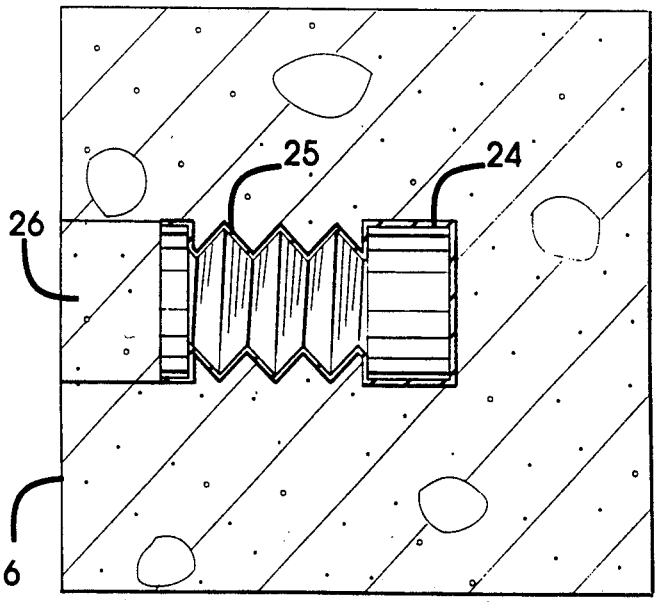
FIG. 14 is a sectional view of the concrete and metal cap embedded after removal of mold.

FIG. 14 showing a section of the metal cap through lines 14 in FIG. 13 embedded in concrete 6 with pilot impression 26.

Figure 15:
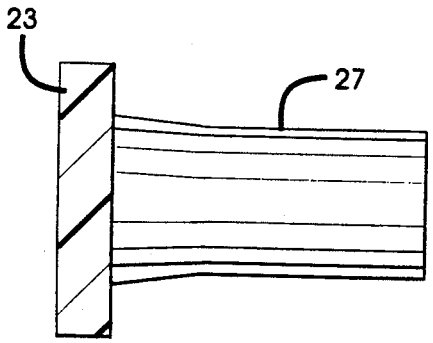
FIG. 15 is a side view of a modified pilot mold for metal cap attachment.

Shown in FIG. 15 is a modified form of pilot mold 27.

Figure 16:
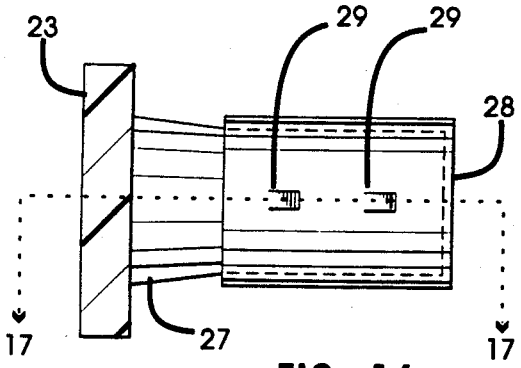
FIG. 16 is a sectional view of part of the base structure with modified pilot mold and metal cap.

FIG. 16 depicts the mold base 23 with pilot mold 27 integrally connected and metal cap 28 with a plurality of locking taps 29.

Figure 17:
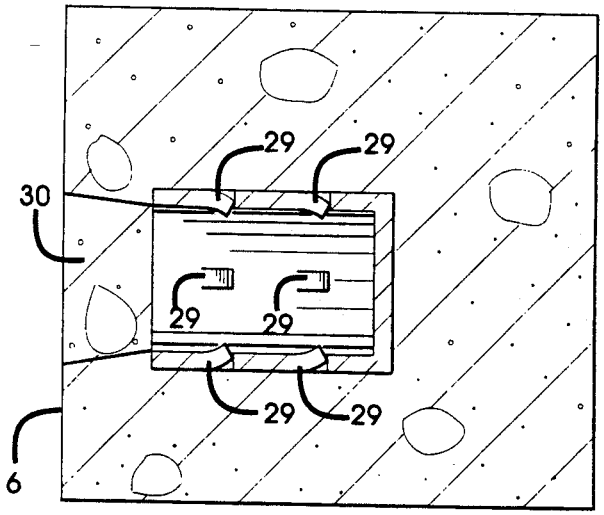
FIG. 17 is a sectional view of the concrete and metal cap embedded after removal of mold.

Referring to FIG. 17 a section of the metal cap shown in FIG. 16 through lines 17 embedded in concrete 6 and pilot mold impression 30.

Figure 18:
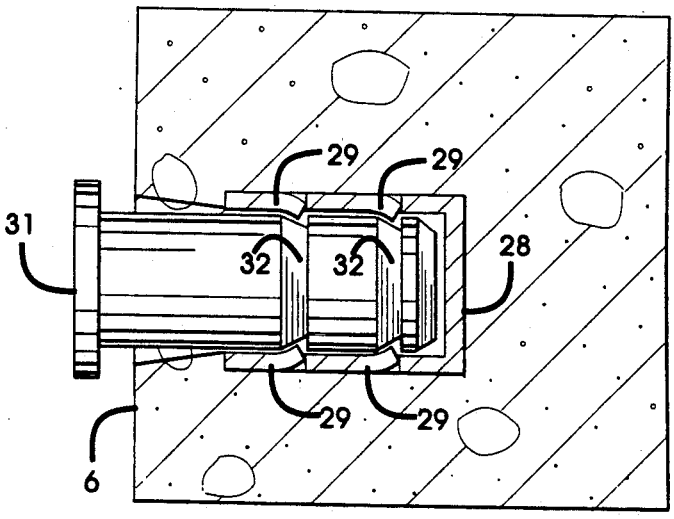
FIG. 18 is the metal cap embedded in concrete in FIG. 17 with annularly grooved steel pin engaged in catches in the metal cap.

Shown in FIG. 18 the section of concrete 6 and metal cap 28 as shown in FIG. 17 with an annular grooved pin 31 into cap and engaged to locking tabs 29.

It is apparent that many modifications of the mold structure are possible without departing from the spirit and scope of the invention. Accordingly, the invention should not be limited except in the light of the appended claims.

Having described the invention, what is claimed is:

1. A mold for impressing pilot holes in concrete, said mold comprising:

a concrete form member for the formation of a concrete structure, said form member having an inner face temporarily placeable in contact with a portion of the concrete structure;

a base structure including a sheet of resilient plastic material, said base structure being of sufficient size to accommodate a plurality of elongated extensions, said base structure being substantially flat for full contact and support of its front face normally positioned flat with the inner face of the concrete form member; and a plurality of elongated extensions constructed of resilient plastic material integrally connected to a back face of said base structure, opposite said front face;

said base structure having an upper distal end extending outwardly from its front face at an angle and positioned in contact with an upper end of said concrete form member, the upper distal end extending outwardly in contact with said concrete form member upper end for temporary attachment wherein the plane of said upper distal end is generally parallel to the upper end of said concrete form member;

said base structure front face extending downwardly to a lower distal end positioned generally in contact with said concrete form member inner face;

said elongated extensions being located on spaced locations and extending at right angles from said base structure back face and terminating generally in a common plane;

said base structure back face running generally parallel with said front face downwardly to a point with a turn at an angle towards said front face extending to a point of a turn at an angle to run again parallel with the front face forming a fine skirt to the lower distal end of said base sheet structure;

said elongated extensions running generally parallel with said base structure upper and lower distal ends throughout the length of the base structure;

said base structure, with said plurality of elongated extensions integrally connected thereto, forming a pilot holes mold;

whereby as concrete is poured and sets, a plurality of pilot holes are impressed in said concrete structure, and whereby as said concrete forms and said pilot holes mold is removed, a plurality of pilot holes are exposed, said pilot holes being used for anchoring connectors.

2. The mold according to claim 1, wherein the material of construction of said pilot holes mold is a resilient plastic composition, the plastic composition being extruded through a die conforming generally with the shape of a cross-section of said base structure and elongated extensions; the extruded continuous shape being cuttable to desired lengths and the extruded continuous shape extending at right angles from the back face is sliceable to form separate pilot holes molds cut to shape and length.

3. The mold according to claim 1, wherein the material of construction of the pilot holes mold is a resilient plastic composition, wherein the pilot holes mold is constructed by injection molding.

4. A mold for impressing pilot holes in concrete, comprising:

a concrete form member for the formation of a concrete structure, said form member having an inner face temporarily placeable in contact with a portion of said concrete structure;

a base structure constructed of resilient plastic material and substantially flat for partial contact and support of its front face at upper and lower ends and at a center portion between said ends normally positioned flat with the inner face of the concrete form member, said base structure center portion being thickened;

said base structure between said ends and center portion being separated from said concrete form member by the center thickened portion;

said base structure having front and back generally parallel faces running upwardly at said upper end to a point with a turn at an angle toward said concrete form member inner face;

said base structure front and back generally parallel faces running downwardly at said lower end to a point with a turn at an angle towards said concrete form inner face;

said upper and lower ends forming substantially flat areas positioned flat with said concrete form member inner face;

said base structure center portion and upper and lower ends being substantially flat and in alignment and positioned generally in contact with said concrete form member inner face;

said center portion having nailing holes for receiving fasteners for attachment of said base structure to said concrete form member; and a plurality of elongated pilot molds integrally connected to and extending at right angles from said base structure back face and terminating generally in a common plane, the pilot molds running generally parallel between the upper and lower ends of the base structure throughout the length of the base structure wherein as said concrete forms and the pilot molds are removed, a plurality of pilot holes are exposed, said pilot holes being used for anchoring connectors.

5. The mold according to claim 4, wherein the material of construction of said base structure and said pilot molds is a resilient plastic composition;

the plastic material being extruded through a die conforming generally with the shape of a cross-section of said base structure and integral pilot molds;

the extruded continuous shape being cuttable to desired lengths and the extruded continuous pilot molds extending at right angles from the back face being sliceable to form separate pluralities of said base structure and integral pilot molds cut to shape and length.

6. The mold according to claim 4, wherein the material of construction of said base structure and said integral pilot molds is a resilient plastic composition, said base structure and integral pilot molds being constructed by injection molding.

7. A mold for impressing pilot holes in a surface of a solidifying concrete structure formed by a concrete form member, said mold comprising:

a mold base temporarily connectable to the concrete form member, said mold base having a substantially flat back face directed away from said form member; and a plurality of mold portions extending from said back face adapted to create pilot holes in the concrete structure as it solidifies, each of said mold portions having a smooth surface and a distal end periphery no larger than a base end periphery, thereby permitting removal of said mold portions from the concrete when solidified, wherein the mold base is substantially flat and has a front face extending substantially parallel to said back face, said mold base having an upper end and a lower end and a central portion therebetween, wherein said upper end and said lower end are angled toward said front face and said central portion is thickened so that said upper end and said lower end and said thickened central portion engage a planar surface of the form member and portions of said front face between the thickened central portion and the upper and lower ends are separated from the form member.

* * * * *